US005489477A

United States Patent [19]

Ohta et al.

[11] Patent Number: 5,489,477

[45] Date of Patent: Feb. 6, 1996

[54] HIGH-MOLECULAR WEIGHT CARBON MATERIAL AND METHOD OF FORMING THE SAME

[75] Inventors: Kuniichi Ohta; Noriaki Hamada, both of Tokyo, Japan

[73] Assignee: NEC Corporation, Tokyo, Japan

[21] Appl. No.: 213,701

[22] Filed: Mar. 16, 1994

[30] Foreign Application Priority Data

Mar. 17, 1993 [JP] Japan ..... 5-056696

[51] Int. Cl.[6] ..... D01F 9/12

[52] U.S. Cl. ..... 428/408; 423/445 B

[58] Field of Search ..... 428/408; 423/445 B

[56] References Cited

U.S. PATENT DOCUMENTS

| | | | |
|---|---|---|---|
| 3,457,042 | 7/1969 | Ettinger | 23/209.1 |
| 3,949,115 | 4/1976 | Tamura et al. | 428/367 |
| 3,972,529 | 8/1976 | McNeil | 273/80 B |
| 4,014,980 | 3/1977 | Fujimaki et al. | 423/448 |
| 4,157,181 | 6/1979 | Cecka | 273/80 R |
| 4,173,670 | 11/1979 | VanAuken | 428/36 |
| 4,628,001 | 12/1986 | Sasaki et al. | 428/367 |
| 4,663,230 | 5/1987 | Tennent | 428/367 |
| 4,816,289 | 3/1989 | Komatsu et al. | 423/447.3 |
| 5,227,038 | 7/1993 | Smalley et al. | 204/173 |
| 5,300,203 | 5/1994 | Smalley | 423/445 |
| 5,346,683 | 9/1994 | Green et al. | 423/447.2 |
| 5,354,926 | 10/1994 | Fagan et al. | 570/129 |

FOREIGN PATENT DOCUMENTS 5-229809 7/1993 Japan .

OTHER PUBLICATIONS

Sumio Iijima, "*Helical Microtubules of Graphite Carbon*", Nature, vol. 354, No. 6348, Nov. 7, 1991, pp. 56–58.

Noriaki Hamada, Shin–ichi Sawada and Atsushi Oshiyama, "*New One–Dimensional Conductors: Graphitic Microtubules*", Physical Review Letters, vol. 68, No. 10, Mar. 9, 1992, pp. 1579–1581.

Sumio Iijima, Toshinari Ichihashi and Yoshinori Ando, "*Pentagons, Heptagons and Negative Curvature in Graphite Microtubule Growth*", Nature, vol. 356, 1992, pp. 776–778.

T. W. Ebbesen & P. M. Ajayan, "*Large–Scale Synthesis of Carbon Nanotubes*", Nature, vol. 358, Jul. 16, 1992, pp. 220–222.

Sumio Iijima, "*Structure of Nanometer Size Graphitic Carbon Tube Filaments*", Int'l Symposium on the Physics and Chemistry of Finite Systems: From Clusters to Crystals, A NATO Advanced Workshop, Oct. 8–12, 1991.

141st Committee for Micro–beam Analysis, Materials for 69th Research Society, Sep. 9–10, 1991, Matsuzaka Heights, JSPS.

Roger Bacon, "*Growth, Structure, and Properties of Graphite Whiskers*", Journal of Applied Physics, vol. 31, No. 2, Feb. 1969, pp. 283–290.

*Primary Examiner*—A. A. Turner

*Attorney, Agent, or Firm*—Burns, Doane, Swecker & Mathis

[57] ABSTRACT

A high-molecular weight carbon material in which cylindrical high-molecular weight carbon materials in the form of a cylindrical tube are bonded through a soccer ball-like spherical high-molecular weight carbon material as a point of junction, the respective cylindrical high-molecular weight carbon materials being formed by rolling a plane network composed of a benzene shell-like hexagonal molecule formed of covalent-bonded carbon atoms, and the soccer ball-like spherical high-molecular weight carbon material being formed of material including five- and six-membered carbon rings. The high-molecular weight carbon material is useful as a material for various functional devices.

23 Claims, 13 Drawing Sheets

HIGH-MOLECULAR WEIGHT CARBON MATERIAL AND METHOD OF FORMING THE SAME

BACKGROUND OF THE INVENTION

1. Field of the Invention

This invention relates to a high-molecular weight carbon material, i.e. a supermolecular carbon material and a method of forming the same, and in particular to a high-molecular weight carbon material, i.e. a supermolecular carbon material, having one-dimensional, two-dimensional or three-dimensional structure in which cylindrical high-molecular weight carbon materials having a fine tubular structure are bonded to soccer ball-like high-molecular weight carbon materials as a point of contact, and a method of forming the same.

2. Disclosure of the Related Art

With a development of high-molecular weight carbon materials, high-molecular weight carbon materials having a fine tubular structure with the nanometered order in a diameter have been recently discovered on a carbon rod after an arc discharge (S. Iijima, *Nature*, Vol. 354, pp. 56–58, 7 Nov. 1991).

These high-molecular weight carbon materials are formed by (a) providing benzene shell-like hexagonal molecules as a constituent unit which are formed by covalent bonding of carbon atoms, (b) placing the molecules tightly in a plane to form a carbon molecule sheet, (c) rolling the carbon molecule sheet into a cylindrical shape to form a cylindrical carbon tube as a unit or a high-molecular building block, (d) repeating the above steps (a)–(c) to form a plurality of cylindrical carbon tubes having different diameters, and thereafter (e) arranging their cylindrical carbon tubes in a concentric configuration to form a telescopic structure.

The above-mentioned cylindrical tubes have an extreme micro-diameter of the order of 1 nm at a minimum and the spacing between a cylindrical tube and its inside cylindrical tube or its outside cylindrical tube is of the order of 0.34 nm which is approximately the same as the interlayer spacing of a graphite molecule. The interaction between tubes is van der Waals type, and electron transfer from tube to tube is very small. In the above-mentioned telescopic structure, there are various kinds of structure such as a double structure, triple structure, quadruple structure, quintuple structure, . . .

The above high-molecular weight carbon material will be hereinafter referred to in some cases as a "(carbon) nanotube" or a "(carbon) tube".

The carbon nanotube takes an almost infinite number of structures, which are characterized by the diameter and the degree of helicity. The relation between the molecular structure and electronic band structure of the carbon nanotube has been taught in Japanese Patent Application No. 56306/1992 which was laid open on Sep. 7, 1993 under Japanese Unexamined Patent Publication No. 229809/1993, the disclosure of which is hereby incorporated by reference herein. In addition, a method of fabricating carbon tube devices having desired properties on the basis of the above relation has been proposed therein.

The above Application No. 56306/1992 and N. Hamada et al., *Phys. Rev. Lett.*, 68(10), pp.1579–1581(1992) teach that the carbon nanotubes exhibit a variety of properties in electronic conduction from a metal to a semiconductor with various band gaps, depending on the radius of the cylindrical tube and the degree of helical arrangement of the six-membered carbon rings (i.e. the carbon hexagons) and that the carbon nanotubes are useful as a material for use in functional devices utilizing such properties.

On the other hand, soccer ball-like spherical high-molecular weight carbon materials having benzene shell-like hexagonal molecules as a constituent unit or molecular building block are taught in S. Iijima et al., *Nature*, Vol. 356, pp. 776–778(1992), the disclosure of which is hereby incorporated by reference herein. S. Iijima et al. have shown that a variety of complex variants of carbon nanotubes are obtained by introducing pentagons and heptagons into the hexagonal network. Also, it is known that the molecules such as $C_{60}$, $C_{70}$, $C_{78}$, $C_{82}$, . . . can stably exist. These soccer ball-like spherical carbon materials are in the solid state or in the form of a face-centered cubic lattice or any other crystal structures depending on van der Waals forces. If the crystal or solid material is doped with K, Rb, Cs or the like, the doped material exhibits the metal conduction and superconductivity at low temperature.

The above-mentioned carbon nanotube and soccer ball-like material and high-molecular weight materials derived from either of them, and properties of these materials are known. However, materials obtained by combining the carbon nanotubes and the soccer ball-like materials have not been yet known and even suggested and such combination is unobvious to a person having ordinary skill in the art. Of course, properties of the combined materials are not entirely known.

SUMMARY OF THE INVENTION

Accordingly, an object of this invention is to provide a high-molecular weight carbon material comprising two carbon materials, i.e. carbon nanotubes and soccer ball-like spherical high-molecular weight carbon materials, and a method of forming the same structures.

The above object is accomplished by providing a high-molecular weight carbon material comprising cylindrical high-molecular weight carbon materials in the form of a cylindrical tube and soccer ball-like spherical high-molecular weight carbon materials as a point of contact or junction, the respective cylindrical high-molecular weight carbon materials having a rolled plane network including a benzene shell-like hexagonal molecule of covalent bonded carbon atoms as a constituent unit and the soccer ball-like spherical high-molecular weight carbon material including molecules with five- and six-membered carbon rings as a constituent unit, and the cylindrical high-molecular weight carbon materials and the soccer ball-like spherical high-molecular weight carbon materials being alternately bonded.

The above object is also accomplished by providing a method of forming the above-mentioned high-molecular weight carbon material, comprising bonding "m", wherein m is an integer of 2 or more, of cylindrical high-molecular weight carbon materials in a form of a cylindrical tube to "n", wherein n is an integer of 1 or more, of soccer ball-like spherical high-molecular weight carbon materials each of which has a radius larger than that of the cylindrical high-molecular weight carbon materials and includes molecules of five- and six-membered rings as a constituent unit so as to alternately connect the cylindrical high-molecular weight carbon material and the soccer ball-like high-molecular weight carbon material, wherein distances between the soccer ball-like spherical high-molecular weight carbon materials are changed by changing length of the cylindrical high-molecular weight carbon materials to thereby change properties of the high-molecular weight carbon material.

According to an embodiment of this invention, there is provided a first basic high-molecular weight carbon material in which two cylindrical high-molecular weight carbon materials having different or same radius are connected through the soccer ball-like spherical high-molecular weight carbon material having a radius larger than that of both the two cylindrical high-molecular weight carbon materials so as to be linearly arranged or be arranged to form any desired angles.

Furthermore, "n", wherein n is an integer of 1 or more, of the soccer ball-like spherical high-molecular weight carbon materials and "m", wherein m=n+1, m=n or m=n−1, of the cylindrical high-molecular weight carbon materials having any desired length are connected alternately to be linearly arranged or be arranged to form a linear-chain with any desired angles. In case of m=n, these materials may be connected alternately to form a ring-shaped product. Furthermore, the ring-shaped high-molecular weight carbon material product may have terminals. In this case, the radius of the cylindrical high-molecular weight carbon material and that of the spherical high-molecular weight carbon material may be any desired radii so far as these materials can be connected with each other.

Properties of the high-molecular weight carbon material can change depending on changes in the distance between the soccer ball-like spherical high-molecular weight carbon materials, i.e. the length of the cylindrical high-molecular weight carbon material.

According to another embodiment of this invention, there is provided a second high-molecular weight carbon material in which three or more of the cylindrical high-molecular weight carbon materials are connected to the soccer ball-like spherical high-molecular weight carbon material as a point of junction.

According to even another embodiment of this invention, there is provided a third high-molecular weight carbon material in which one cylindrical high-molecular weight carbon material or the first basic high-molecular weight carbon material is connected to the second high-molecular weight carbon material as a point of junction.

According to yet another embodiment of this invention, there is provided a fourth high-molecular weight carbon material relating to a network-shaped high-molecular weight carbon material in which the junction points in the third high-molecular weight carbon material have a periodic structure or a topologically structural order which is two-dimensionally or three-dimensionally arranged.

In the above-mentioned one-dimensional products (i.e. tubes-balls) including the cylindrical high-molecular weight carbon materials and the soccer ball-like spherical high-molecular weight carbon materials, properties thereof can be changed continuously from a semiconductor to a metal and vice versa depending on arrangement of these tubes and balls or the distance between the balls. The same statements are true for the two-dimensional and three-dimensional products.

The band mass can be varied depending on the distance between the balls. In the bands in the metal state, one of the two bands crossing the Fermi level has great change in energy as a function of the wavenumber k (great dispersiveness) and leads to a small effective mass whereas the other band has no dispersiveness and has infinite mass. Thus, the mass of the bands can be controlled.

The above-mentioned first to fourth high-molecular weight carbon materials relate to a high-molecular weight carbon material in which the spherical high-molecular weight carbon materials form localized centers of electrons and the electrons are subjected to hopping conduction among these localized centers one by one under conditions that strong repulsion force between electrons makes it difficult to increase or decrease the number of localized electrons on each spherical carbon material by two or more.

The term "high-molecular weight carbon material" as a product means one-, two- and three-dimensional materials consisting of or characterized by a series of ball-like spherical materials alternating with cylindrical tube-like materials and, in other words, a moniliform high-molecular weight material.

The foregoing and other objects and features of this invention will be apparent from the following description.

BRIEF DESCRIPTION OF THE DRAWINGS

FIGS. 5A, 5B, 5C, 5D and 5E show schematical views of a second example of this invention, in which FIG. 5A shows schematical view of bent high-molecular weight carbon material comprising two cylindrical carbon tubes and a soccer ball-like spherical carbon material (i.e. a junction point), FIGS. 5B–5E show schematically regular polygonal rings with the number of junction points of 3, 4, 5 and 6, respectively;

FIGS. 6A–6E are schematical views showing structures with three or more legs (i.e. cylindrical carbon tubes) according to a third example of this invention, respectively, in which FIG. 6A shows a three-legged structure with one leg in the direction of each apex of a regular triangle from the center of gravity thereof, FIG. 6B shows a three-legged structure in the form of T-type, FIG. 6C shows a four-legged structure in the form of a cross in the same plane, FIG. 6D shows a four-legged structure with one leg in the vector direction of each apex of a regular tetrahedron from the center of gravity thereof, FIG. 6E shows a plane structure with six legs in the form of starfish and FIG. 6F shows a cubic structure with six legs in the direction of x, y and z;

DETAILED DESCRIPTION OF THE PREFERRED EMBODIMENTS

The high-molecular carbon material according to this invention can be formed as follows.

As for the soccer ball-like spherical high-molecular weight carbon material, for instance, a method of forming a $C_{60}$ fullerene is well-known (e.g. the above S. Iijima et al., *Nature*, Vol.356, pp.776–778(1992)). The carbon nanotubes are taught in the above S. Iijima, *Nature*, Vol.354, pp.56–58(1991); the above S. Iijima et al., *Nature*, Vol.356, pp.776–778(1992); and T. W. Ebbesen et al., *Nature*, Vol.358, 16 Jul., pp.220–222(1992), the disclosure of which is hereby incorporated by reference herein.

Figure 1A:
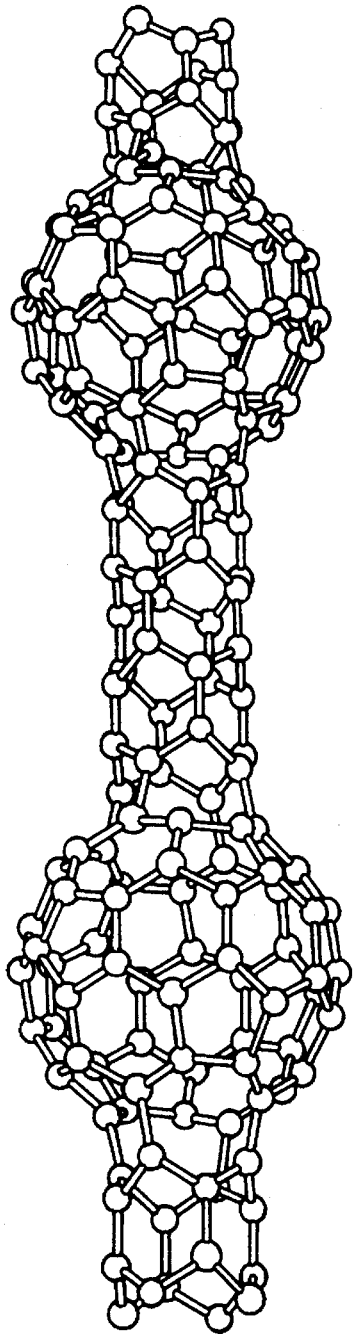
FIG. 1A is a partial and schematical view of a first example of a one-dimensional high-molecular weight carbon material, which includes cylindrical high-molecular weight carbon materials in the form of a tube and soccer ball-like spherical high-molecular weight carbon materials, according to this invention.
Figure 1B:
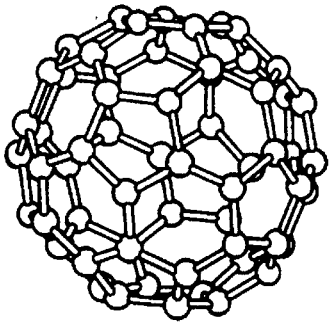
FIGS. 1B, 1C and 1D show schematical views for explaining individual constituent units of the carbon material shown in FIG. 1A, respectively.
Figure 1C:
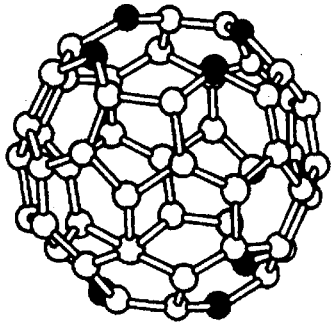
Figure 1D:
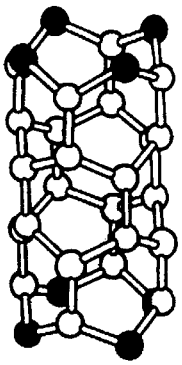

In order to form a tube or nanotube of A(4,0) type (which is defined below) as shown in FIG. 1D, the A(4,0) tube is first chosen among nanotubes, which were formed according to the above-mentioned prior method, by means of a high-accurate manipulator while observing them by an electron microscope. Then, the tube thus chosen is broken off at the chip or chips thereof to give a cut cross-section or cut cross-sections shown in FIG. 1D. Namely, the cross-section is formed by selecting four desired bonds in the direction of axis (the axial bonds stood on four filled spheres(the upper portion of the tube shown in FIG. 1D) in an upright position, before cutting) and then cutting the selected bonds, for instance, by irradiating them with focused electron beam (beam diameter: about 1–2 Angstroms; bond length: 1.42 Angstroms). This cutting is required because both chips of the tube are in most cases enclosed in an ordinary growth process. The resulting cross-section has dangling bonds. If the tube reacts at room temperature in the presence of a Pd or Pt catalyst in an atmosphere of $H_2$, hydrogen atoms are bonded to the dangling bonds on one or both of the cut sections to form saturated section or sections.

Figure 2:
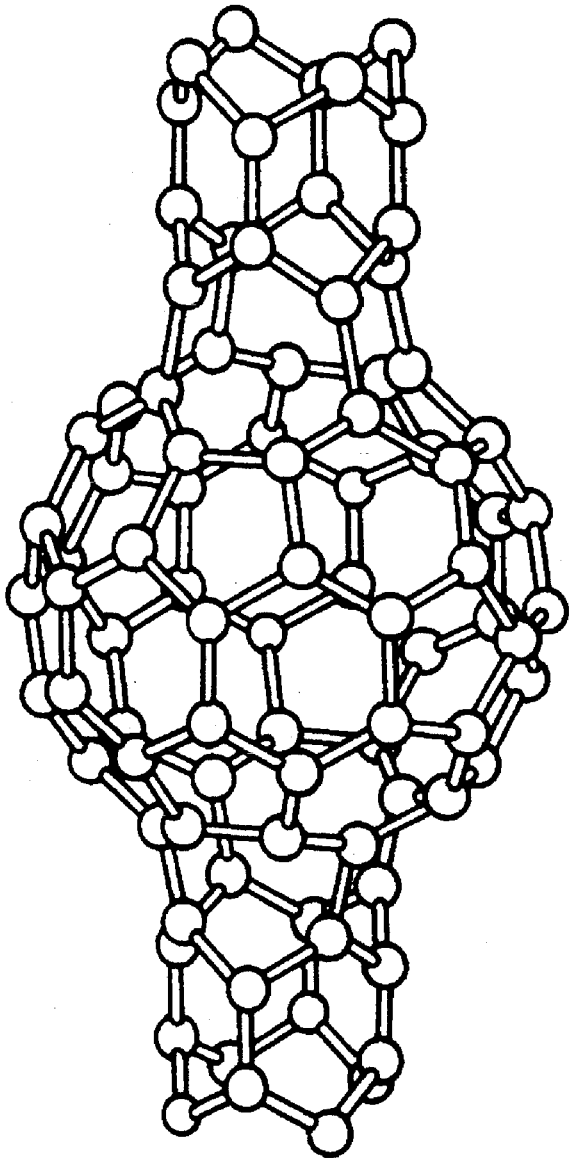
FIG. 2 is a schematical view showing a basic constituent unit of the high-molecular weight carbon material for explaining Examples of this invention.

Then, the soccer ball-like spherical high-molecular weight carbon material and the A(4,0) nanotubes each having only one section saturated by hydrogen atoms are mixed in the proportion 1:2 and react at temperature approaching 250° C. in the presence of a Pd catalyst to form a basic constituent unit of a high-molecular weight carbon material as shown in FIG. 2 according to the following scheme (1).

$$2\text{A}(4,0)\ \text{tube}\begin{matrix}\diagup \text{H} \\ \diagdown \text{H}\end{matrix} + C_{60} \longrightarrow \text{A}(4,0)\text{-}C_{56}\text{-A}(4,0) + 4\text{C-H} \qquad (1)$$

In this case, the basic constituent unit is formed in such a way that the A(4,0) tubes are connected to the soccer ball-like spherical material at points which are just symmetrical with respect to each other, i.e. at the north and south poles, because of energetic stability. However, it should be appreciated that another constituent unit, in which the tubes are connected to the soccer ball at points which are asymmetrical with respect to each other so as to form any desired angles, is also formed in a statistical distribution.

A high-molecular weight carbon material with a one-dimensional arrangement is formed of the above-mentioned basic constituent units as follows.

The chip of each of two A(4,0) tubes in the basic constituent unit is broken off by means of the high-accurate manipulator while observing it by the electron microscope. Since these fresh chips have the dangling bonds as mentioned above, they are hydrogenated at room temperature in the presence of a Pd catalyst. A plurality of the basic constituent units each having both chips hydrogenated as mentioned above are allowed to react in the neighborhood of 250° C. in the presence of the Pd catalyst. Hydrogen atoms in the sections of the tube are desorbed therefrom and thus the sections are bonded to each another to form the one-dimensional high-molecular weight carbon material.

In this case, each terminal portion of the high-molecular weight carbon material is the A(4,0) tube. In contrast thereto, the high-molecular weight carbon material in which a terminal portion is the soccer ball can be formed by mixing materials, each of which comprises only one A(4,0) tube bonded to a soccer ball and having one hydrogenated section, with another materials each of which comprises one soccer ball and two A(4,0) tubes bonded thereto and has hydrogenated sections, and then being subjected to a dehydrogenation reaction under Pd, with a certain degree of yield. The soccer ball to which only one A(4,0) tube is connected is formed by mixing the A(4,0) tube, in which the section of only one side is hydrogenated, with the soccer ball in the proportion of 1:1 and then dehydrogenating the resulting mixture under Pd at 250° C.

The distance between the balls in the above one-dimensional material product can be controlled by changing the length of the A(4,0) tube (i.e. that of a branch) in the basic constituent unit. This can be made by adjusting the length of the A(4,0) tube when breaking off or cutting it while observing it by the electron microscope. As mentioned above, the cutting is performed by selecting four desired bonds and then cutting the selected bonds, for instance, by irradiating them with focused electron beam (beam diameter: about 1–2 Angstroms; bond length: 1.42 Angstroms) while observing them by STEM (Scanning Transmission Electron Microscope), on the basis of the principle of electron beam lithography.

In addition, another high-molecular weight carbon material, in which A(4,0) tubes are bonded to soccer balls at contact points which are asymmetrical with respect to each other to form any desired angles, is formed by providing a basic constituent unit, in which the tubes and soccer ball are bonded to form any desired angles and a cut cross-section or cut cross-sections of the tubes are hydrogenated, and carrying out a dehydrogenation reaction of a mixture of the units under a Pd catalyst in the neighborhood of 250° C. In this case, ring-shaped high-molecular weight carbon material are formed with a certain probability. Thus, the predetermined high-molecular weight carbon material is chosen among these products while observing them by an electron microscope or scanning transmission electron microscope.

Any desired final products can be formed by predetermining the proportion of raw materials to be used in the above reaction.

Linear or straight carbon materials can be formed of a linear or straight basic constituent unit. Ring-shaped high-molecular weight carbon materials can be formed of a basic constituent unit in which the A(4,0) tubes and soccer ball are bonded so as to form any desired angles.

The two- and three-dimensional networks are formed of a basic constituent unit comprising a soccer ball and three or more of carbon nanotubes bonded to the ball. An "n"-legged soccer ball is formed by mixing "n" of A(4,0) tubes each having a hydrogenated section at only one side and the soccer ball in the proportion of n:1 and then reacting the mixture in the neighborhood of 250° C. under a Pd catalyst. In this case, generally, the product has good symmetry as shown in FIGS. 6A–6F, but a mixture of asymmetrical balls with branches being bonded thereto in various directions can be also formed.

Figure 7:
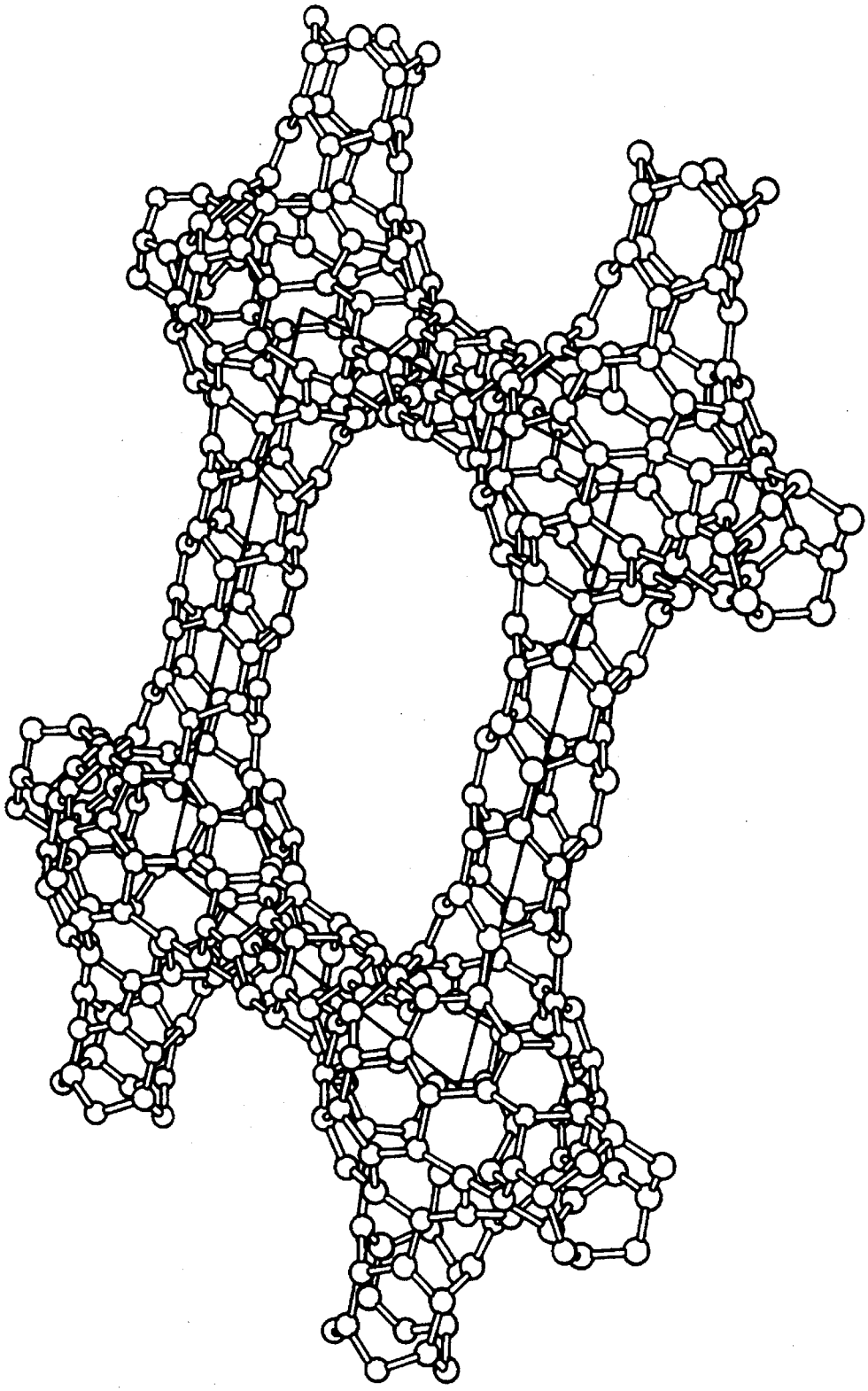
FIG. 7 is a schematical and partial view of a two-dimensional high-molecular weight carbon material in the form of a plane square lattice according to a fourth example of this invention.
Figure 9:
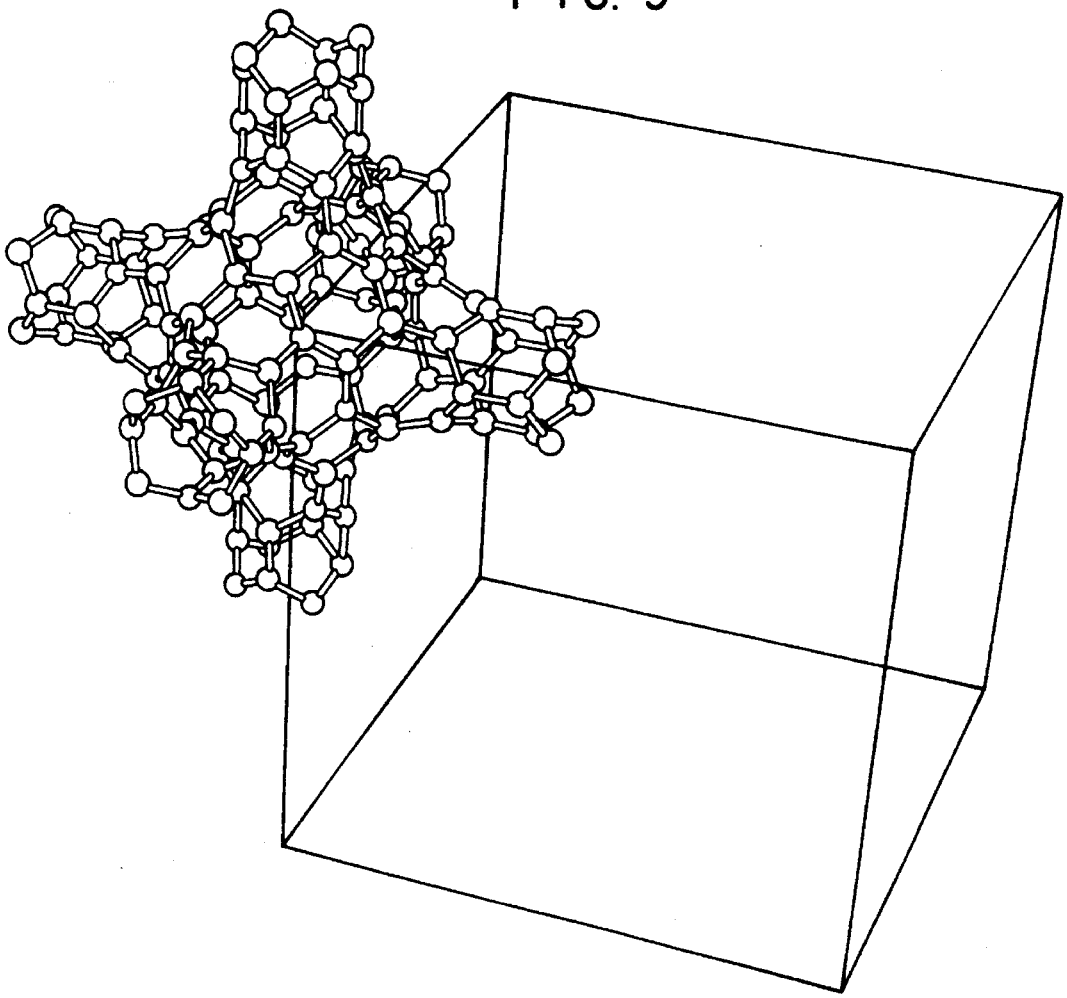
FIG. 9 is a schematical and partial view showing a three-dimensional high-molecular weight carbon material in the form of a simple cubic lattice according to a fifth example of this invention.

For instance, the two-dimensional network as shown in FIG. 7 is formed by hydrogenating the chip of each branch of four-legged ball and then dehydrogenating a plurality of hydrogenated balls in the neighborhood of 250° C. in the presence of the Pd catalyst, in the same manner as mentioned above. The cubic structure as shown in FIG. 9 can be formed by combining the same procedures as mentioned above.

Next, an alternative method of forming the cut cross-section of the A(4,0) tube as shown in FIG. 1D will be hereinafter described. In general, the A(4,0) tube is grown by an arc discharge method using graphite electrodes. In this case, the above-mentioned section can be formed by quickly stopping the discharge. The length of the A(4,0) tube to be grown can be controlled depending on growth time.

Alternatively, a method of forming the high-molecular weight carbon material according to this invention will be described as follows, provided that the soccer ball and the tube with hydrogenated sections as shown in FIG. 1D are formed as mentioned above. In bonding the ball and tubes to each other by the dehydrogenation, the ball is brought into contact with the tubes having the hydrogenated sections at the prescribed positions by means of the high-accurate manipulator while observing them by the electron microscope, and then they are irradiated with ultraviolet ray to cause the dehydrogeneration reaction and complete bonding. In this method, the bonding between the ball and the tubes can be controlled one by one.

As mentioned above, the one-dimensional, two-dimensional and three-dimensional high-molecular weight carbon materials according to this invention can be formed by bonding the cylindrical high-molecular weight carbon materials to each of the spherical high-molecular weight carbon materials as a point of contact.

Electronic states of the products deeply reflect one-dimensional characters in the cylindrical high-molecular weight carbon material. Namely, the density of states in the products retains spiky structure in the cylindrical carbon material. Thus, it will be appreciated from the electronic states that the one-dimensional characters are modulated by the cubic structure formed of the cylindrical carbon material. The soccer ball as the junction point forms the localized state in situ. Combination of the above-mentioned functions determines the density of states and Fermi level throughout the whole product. Thus, the three-dimensional structure can give the band structure and conductivity which are different from those of the tube alone. In addition, the stability in the structure of the product is kept.

Next, this invention will be hereinafter be described in more detail with reference to the non-limitating working Examples and accompanying drawings.

Figure 15:
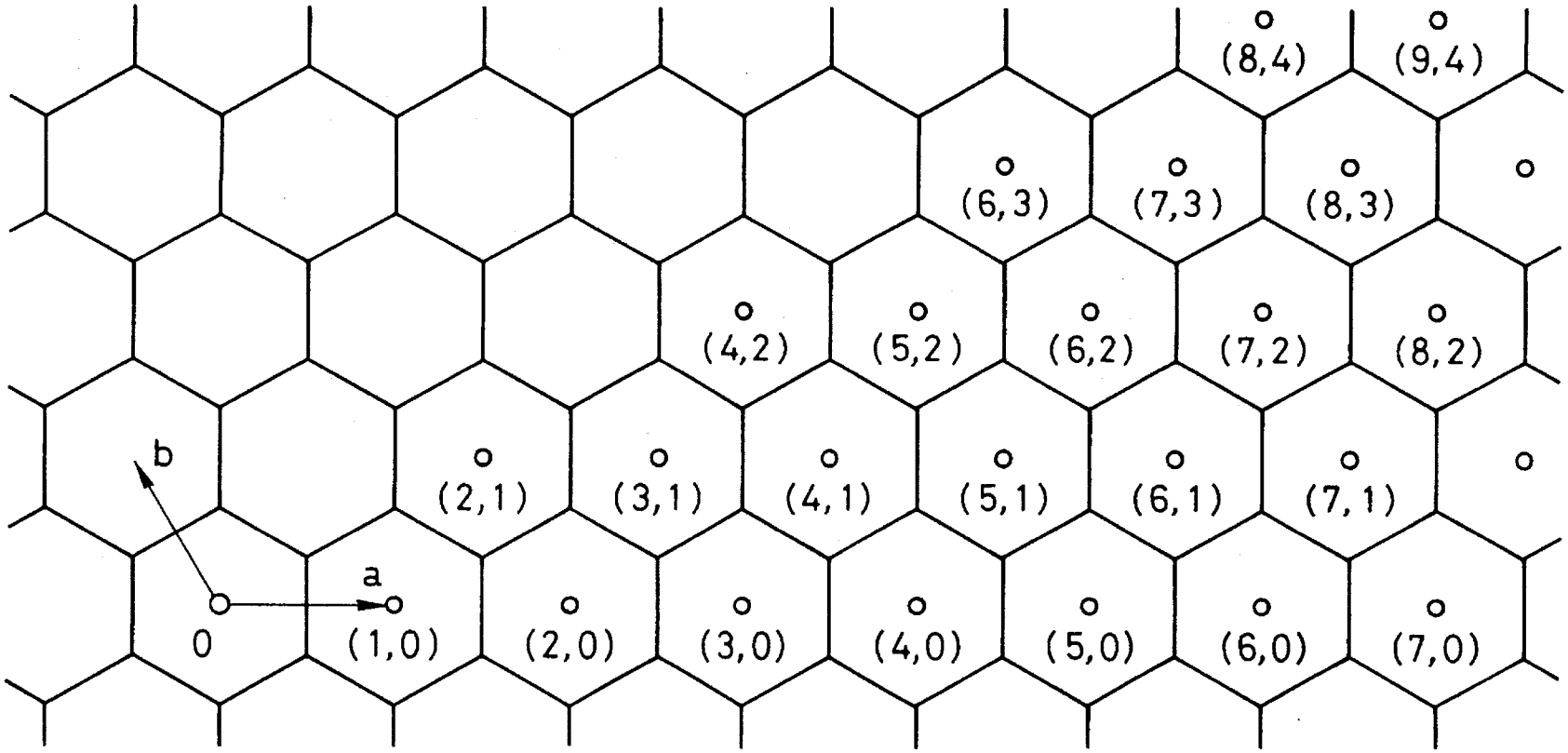
FIG. 15 is a view for explaining a definition of the molecular structure of the cylindrical high-molecular weight carbon material in this invention.

In this invention, the cylindrical high-molecular weight carbon material in the form of a cylindrical tube is formed by rolling a network of a plane net which includes a benzene shell-like hexagonal molecule formed of covalent-bonded carbon atoms as a constituent unit, as taught in the aforementioned N. Hamada et al., Phys. Rev. Lett., 68(10), pp.1579–1581(1992). Namely, the network is rolled in such a way that, if one of parallel sides of the carbon hexagon in the above net are arranged in the y-direction of the network, the origin (0, 0) is chosen on the center of gravity of any carbon hexagon, the carbon hexagons arranged on the right of the origin, i.e. arranged in the direction of vector "a" shown in FIG. 15, are in order represented in terms of $(n_1, 0)(n_1=1, 2, 3, \ldots)$, the carbon hexagons arranged on the upper left of the origin, i.e. arranged in the direction of vector "b" shown in FIG. 15, are in order represented in terms of $(0, n_2)(n_2=0, 1, 2, \ldots)$ and any carbon hexagon arranged on the optional position is represented in terms of $(n_1, n_2)$, the carbon hexagon $(n_1, n_2)$ is just superposed on the carbon hexagon (0, 0)(FIG. 15).

The above-mentioned cylindrical high-molecular weight carbon material will be herein represented in terms of an index $A(n_1, n_2)$.

EXAMPLE 1

Referring to now FIG. 1A, there is shown a schematical and partial view of a first example of a one-dimensional high-molecular weight carbon material according to this invention. As shown in FIG. 1A, cylindrical tubes with index A(4,0) are bonded to soccer ball-like spherical high-molecular weight carbon materials, $C_{60}$. In FIGS. 1A–1D, a sphere represents an atom, a filled sphere represents an atom with a dangling bond and a line represents a bond. The structure will be described as follows.

As parts of the material shown in FIG. 1A, there are used $C_{60}$ fullerenes and A(4,0) tubes as shown in FIGS. 1B–1D. First, two carbon atomic pairs are removed from the surface of each of up and down sides of the $C_{60}$ fullerene shown in FIG. 1B to form a $C_{56}$ cluster shown in FIG. 1C. The $C_{56}$ cluster has four dangling bonds at the surface of each sides. Separately, a short A(4,0) tube with two-unit length as shown in FIG. 1D is prepared as mentioned above. The tube has four dangling bonds on each end or chip and is saturated with hydrogen atoms. The $C_{56}$ cluster shown in FIG. 1C and the A(4,0) tube shown in FIG. 1D are bonded alternately to form a basic constituent unit for the one-dimensional high-molecular weight carbon material, the unit including one ball and two tubes as shown in FIG. 2. By repeating such bonding procedure, it is possible to form the one-dimensional balls-tubes with an infinite length as shown in FIG.

1A. The infinite balls-tubes comprises infinite balls and A(4,0) tubes. Also, each ball has pentagons and hexagons, which makes it possible to have A(4,0) tubes on both sides of the ball.

In the above-mentioned one-dimensional balls-tubes, properties thereof can be freely converted from a semiconductor to a metal and vice versa depending on arrangement of the balls and A(4,0) tubes.

Figure 3A:
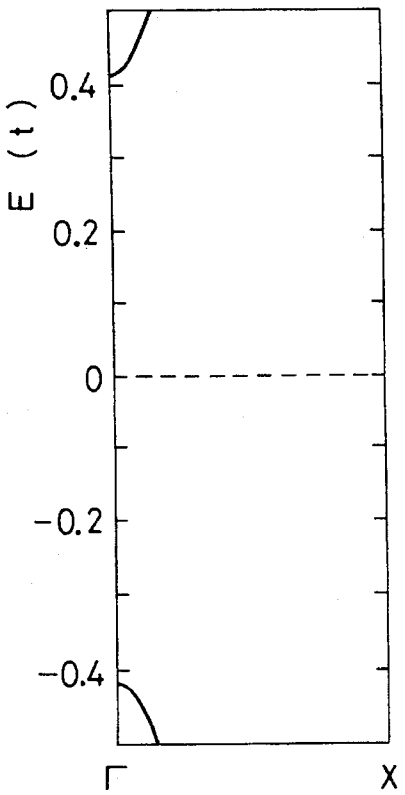
FIGS. 3A and 3B are diagrams showing comparison of band structures for the infinite cylindrical high-molecular weight carbon material as shown in FIG. 1D and for the infinite high-molecular weight carbon material as shown in FIG. 1A, respectively, and the upper diagrams of FIGS. 3A and 3B are partially expanded diagrams of the lower diagrams thereof, respectively.
Figure 3B:
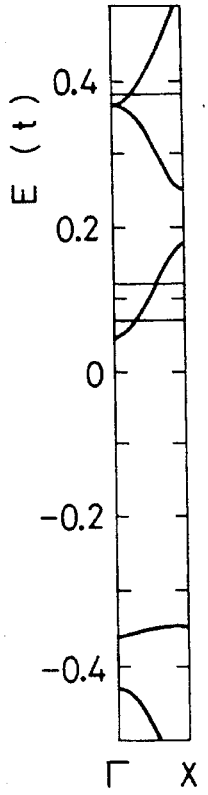
Figure 3B:
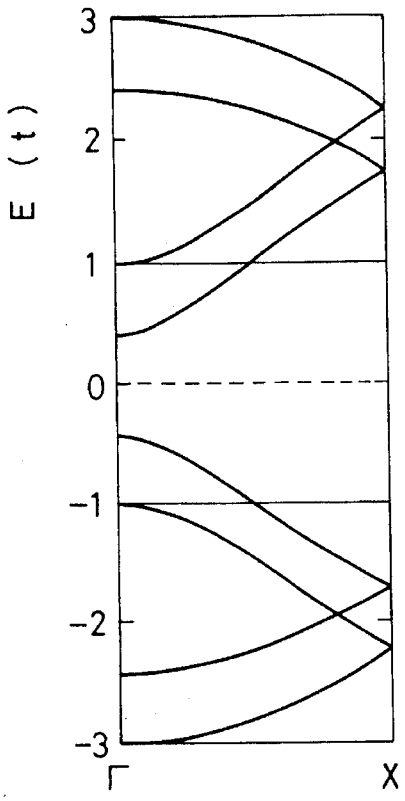
Figure 3B:
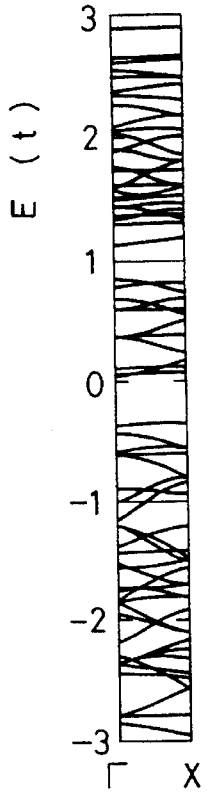

Referring to now FIGS. 3A and 3B, there are shown band structures for the A(4,0) tube and for the resulting one-dimensional balls-tubes, respectively. In the diagrams, the ordinate shows electron energy (in unit of t=3 eV) and the abscissas shows electron wavenumber k, and the upper diagrams show partially expanded diagrams of the lower diagrams, respectively. The A(4,0) tube is a one-dimensional semiconductor with a band gap of 0.828 t (t=3 eV) as shown in FIG. 3A. The one-dimensional balls-tubes as shown in FIG. 1A is in a metal state as shown in FIG. 3B, in which two bands cross the Fermi level at 0.067 t. One band is dispersive and the other is non-dispersive. The non-dispersive band and Fermi level are shown in a single line (at the level of 0.067 t) in the upper expanded diagram of FIG. 3B. The former band has a light mass, which can be varied by varying the period of modification. The latter band has an infinitely heavy mass, which is due to the simple tight-binding model. The shrinking of the Brillouin zone is caused by its folding due to the long period of the one-dimensional balls-tubes. The states around the Fermi energy are situated in the energy-gap region of the A(4,0) tube, and become impurity states localized at balls if the distance between balls is increased. Thus, the band mass can be controlled and it is possible to produce impurity states in a gap.

Figure 4A:
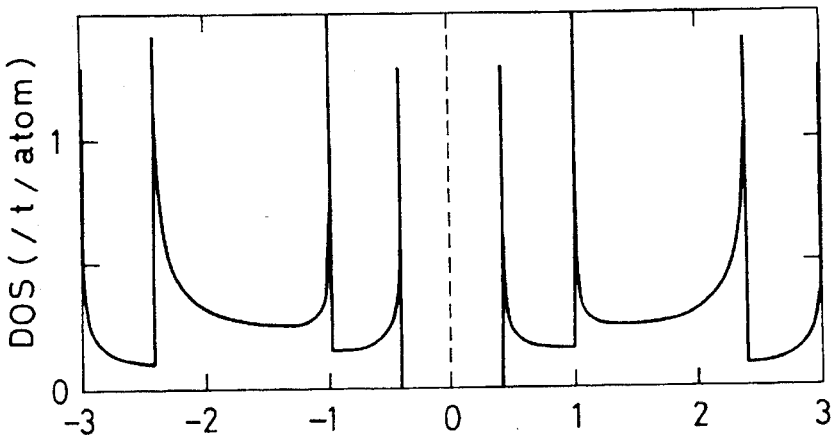
FIGS. 4A and 4B are diagrams showing the densities of electronic states of the cylindrical high-molecular weight carbon material shown in FIG. 1D and the high-molecular weight carbon material shown in FIG. 1A, respectively.
Figure 4B:
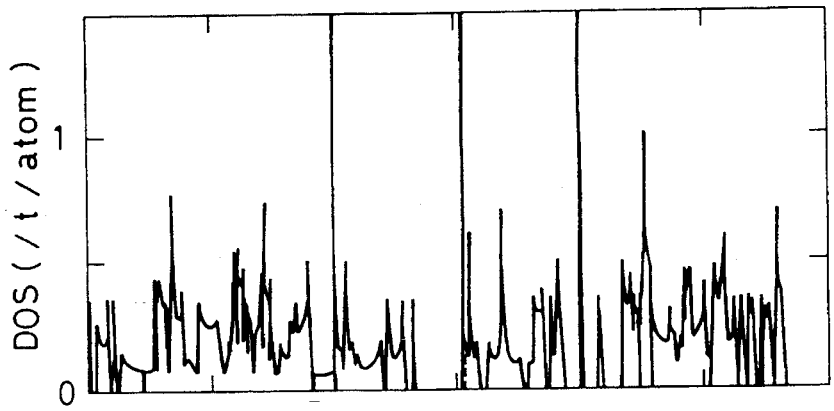

Referring to now FIGS. 4A and 4B, there are shown the densities of electronic states of the A(4,0) tube as shown in FIG. 1D and those of the one-dimensional balls-tubes as shown in FIG. 1A, respectively. In the diagrams, the ordinate shows density of states (DOS) and the abscissas shows energy (in units of t). The DOS of the one-dimensional balls-tubes (FIG. 4B) significantly leaves the spiky structure of DOS of the A(4,0) tube. Impurity states are formed in the band gap region of the A(4,0) tube and metallic properties are obtained.

The band mass can be varied depending on the distance between the balls. In the bands in the metal state as shown in FIG. 3B, one of the two bands crossing the Fermi level has great change in energy as a function of the wavenumber k (great dispersiveness) and leads to a small effective mass whereas the other band has no dispersiveness and has infinite mass. Thus, the mass of the bands can be controlled by the above-mentioned method.

If the distance between balls in the one-dimensional balls-tubes is increased, the electronic states around the Fermi energy and located at balls are situated in the energy-gap region of the A(4,0) tube and in fact become impurity states localized at balls. The densities of electronic states of the A(4,0) tube can be controlled by changing the arrangement of balls, whereby it is possible to play a role of acceptor and donor. Thus, there can be obtained N-type and P-type semiconductor tubes.

EXAMPLE 2

Referring now to FIGS. 5A, 5B, 5C, 5D and 5E, there are shown schematical views of a second example of this invention, respectively. In the drawings, a line represents a cylindrical high-molecular weight carbon material, i.e. a carbon nanotube, and a sphere represents a soccer ball-like spherical high-molecular weight carbon material, i.e. a carbon ball.

Figure 5A:
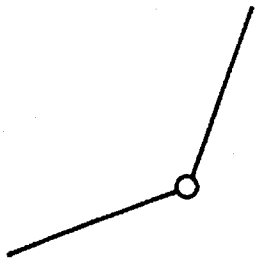
Figure 5B:
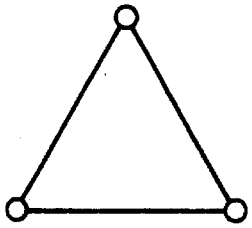
Figure 5C:
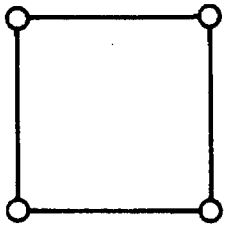
Figure 5D:
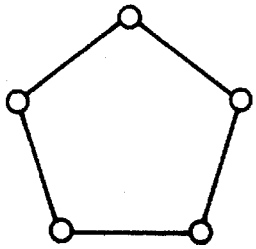
Figure 5E:
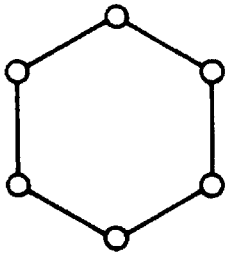

As shown in FIG. 5A, two cylindrical tubes are connected and bonded through a ball so that they are not arranged in the form of a straight line and are bent to form any desired angles. A constituent unit having such structure can be made by removing two carbon atomic pairs situated at a certain finite center angle (exclusive of 180°) from the surface of each of two sides of the ball and bonding each of the cylindrical tubes of A(4,0) to the positions. This means that the positions of the two carbon atomic pairs which are removed from the soccer ball-like spherical high-molecular weight carbon material are not symmetrical with respect to each other as shown in Example 1 (FIG. 1C). By choosing the positions of junction points on the surface of the ball so as to form any desired angles, the bending angle can be changed. FIGS. 5B–5E show regular polygons in which the number of balls as a junction point formed in the manner as mentioned above is 3, 4, 5 and 6, respectively. However, this invention is not restricted to the regular polygons as shown in these views. In general, any desired polygons can be formed by optionally choosing the length of tube and the angle at the junction points with respect to each other. As for the bending angle at the junction points, in general, any desired angles cannot be continuously taken and only discrete angles can be taken. Thus, a problem exists in that it is necessary to slightly modify the angle of junction points in the individual polygons. Some polygons cannot stably exist due to the energy of deformation. Of course, this invention excludes such instable polygons. However, it will be self-evident from the above-mentioned matters that the structure as shown in FIGS. 5B–SE can be generally realized. In the case that the ring (polygon) is sufficiently large and the number of balls is sufficiently many, the bending angle is small and the energy of deformation is low. Thus, no problem on the stability of the structure is caused.

Energy spectra of the above polygonal ring can be qualitatively estimated from the one-dimensional band structure of the linear carbon balls-tubes. Namely, it will be appreciated that the effect of forming the ring imposes periodic boundary conditions with a period of perimeter length of the ring to first approximation. In this case, wavenumbers "k" of the one-dimensional band are good quantum number and discontinuous and discrete values defined quantum mechanically are only allowed. If the number of balls is "M" wherein M represents an integer of 3 or more, it will be appreciated that k points of "M" at equal intervals are chosen and the energy eigenvalue of the one-dimensional band at each of the chosen points corresponds to that of the ring. Since the bending at the junction points locally causes perturbation, it has an effect of increasing the relative weight of a localized state in the band gap. However, the band structure of the ring is apt to be changed from the semiconductor to the metal, in the same manner as in the linear carbon balls-tubes formed in Example 1, depending on the length of each of the cylindrical carbon nanotubes between the balls.

In the above-mentioned system, therefore, it will be understood that the band structure of the ring can be actually changed continuously from the semiconductor to the metal depending on the distance between the balls.

Similarly, size of effective mass of the above-mentioned system and an impurity state therein can be changed in the same manner as in the one-dimensional linear carbon balls-tubes system of Example 1.

EXAMPLE 3

Referring now to FIGS. 6A to 6F, there are shown schematical views of three or more legged structures of a third example according to this invention.

This example relates to a system that each of soccer balls $C_{60}$ has three or more of contact points, i.e. that the three or more cylindrical carbon nanotubes are bonded to each of the balls. The three or more cylindrical tubes branch off from the soccer ball.

A method of making the above system will be hereinafter explained by way of example to show the three-legged structure.

The two carbon atomic pairs are removed from each of any three pairs (pairs such as defined by FIGS. 1B and 1C) situated on the surface of spherical body of the soccer ball and then A(4,0) tubes are bonded to the holes thus made, in the same manner as in Example 1 to form the above system.

In general, "P" legged structures wherein P is an integer of 3 or more are formed by removing the two carbon atomic pairs from each of "P" pairs situated on the surface of the spherical body of the ball and then bonding each of "P" of A(4,0) tubes to the resulting hole.

Figure 6A:
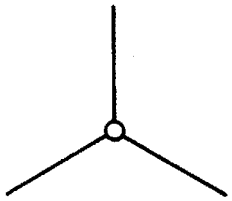
Figure 6C:
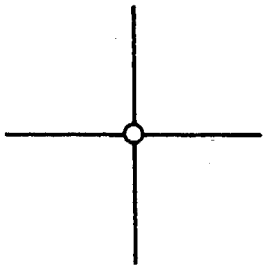
Figure 6E:
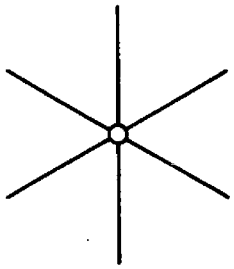
Figure 6B:
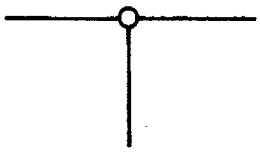
Figure 6D:
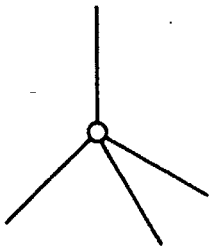
Figure 6F:
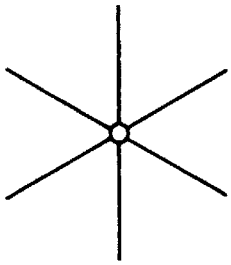

As for the three-legged structure, for instance, FIG. 6A shows a symmetrical two-dimensional three-legged structure with one leg in the direction of each apex of a regular triangle in a plane from the center of gravity thereof, and FIG. 6B shows a three-legged structure in the form of T-type. As for the four-legged structure, for instance, FIG. 6C shows a four-legged structure in the form of a cross in the same plane, and FIG. 6D shows a cubic four-legged structure with one leg in the vector direction of each apex of a regular tetrahedron from the center of gravity thereof. As for the six-legged structure, for instance, FIG. 6E shows a plane structure with six legs in the form of starfish, and FIG. 6F shows a cubic six-legged structure with legs in the direction of x, y and z. The above-mentioned structures as shown in the drawings are symmetrical but may be asymmetrical.

EXAMPLE 4

Referring now to FIG. 7, there is shown a schematical and partial view of a fourth example of a two-dimensional high-molecular weight carbon material according to this invention, in which cylindrical carbon tubes with index A(4,0) are bonded to soccer ball-like spherical high-molecular weight carbon materials $C_{60}$. In other words, FIG. 7 shows a two-dimensional square lattice made of plane four-legged and cross-shaped constituent units.

The above two-dimensional system is formed by using the same method as in the above-mentioned one-dimensional system. Namely, the constituent unit in the two-dimensional system comprises a $C_{60}$ ball and four A(4,0) tubes. Four carbon atomic pairs are removed from a $C_{60}$ fullerene to form a $C_{52}$ cluster. The clusters and A(4,0) tubes are arranged in a two-dimensional manner to form the square lattice as shown in FIG. 7.

Figure 8:
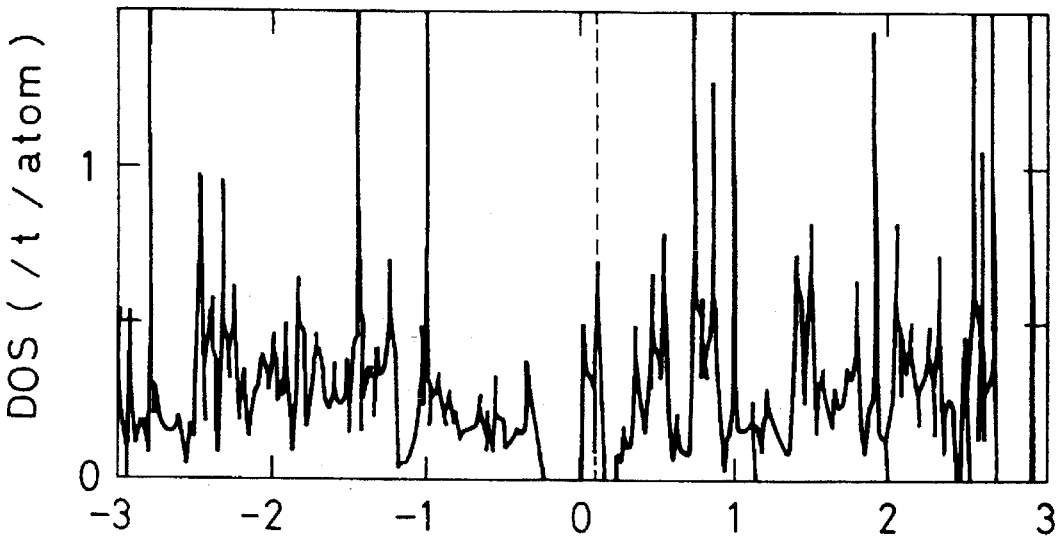
FIG. 8 is a diagram showing the densities of electronic states of the plane square lattice shown in FIG. 7.

Densities of electronic states of the bands of the square lattice thus obtained are shown in FIG. 8. In the diagram, the ordinate shows density of states (DOS) and the abscissas shows energy (in unit of t). Structure of the bands of the product exhibits metallic states while maintaining the one-dimensional spiky state density. Also, in the region with the band gap of the A(4,0) tube, bands of state caused by the balls exist. It is possible to vary the band structure by changing the length of the tube between the lattice points. Increasing further the length of tube to a certain degree, level of impurity band due to the balls is narrowed in the semiconducting band structure due to tubes, and the correlated hopping condition among ball sites emerges. Change in the geometrical parameters as mentioned above makes it possible to control the whole band structure including the impurity levels.

EXAMPLE 5

Referring now to FIG. 9, there is shown a schematical and partial view of a fifth example of a three-dimensional high-molecular weight carbon material according to this invention, in which cylindrical tubes with index A(4,0) are bonded to soccer ball-like spherical high-molecular weight carbon materials $C_{60}$. In other words, FIG. 9 shows a three-dimensional simple cubic lattice made of a six-legged constituent unit.

The three-dimensional system is formed by using the same method as in the above-mentioned one-dimensional system. Namely, the constituent unit comprises a $C_{60}$ ball and six A(4,0) tubes. Six carbon atomic pairs are removed from a $C_{60}$ fullerene to form a $C_{48}$ cluster. The clusters and A(4,0) tubes are arranged in a three-dimensional manner to form the simple cubic lattice as shown in FIG. 9.

Figure 10:
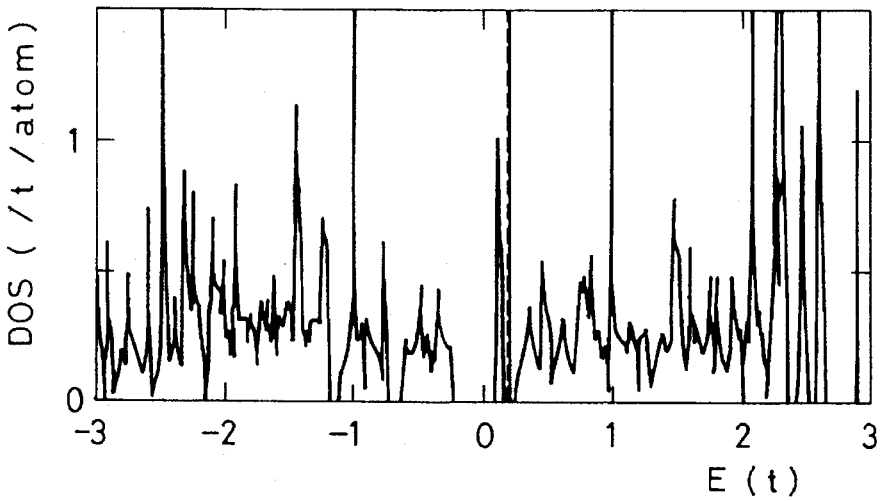
FIG. 10 is a diagram showing the densities of electronic states of the simple cubic lattice shown in FIG. 9.

Densities of electronic states of the bands of the simple cubic lattice thus obtained are shown in FIG. 10. In the diagram, the ordinate shows density of states (DOS) and the abscissas shows energy (in unit of t). Structure of the bands of the product exhibits the spiky state density of the one-dimensional band structure of the A(4,0) tube. Also, in the region with the one-dimensional band gap of the A(4,0) tube, the localized states of the balls are formed. In this case, however, the resulting three-dimensional system has a very high symmetry of $O_h$, while it also has the one-dimensional feature. Thus, the three-dimensional system is semiconducting with acceptor states and donor states just near the Fermi level. However, since the distance of energy between the Fermi level and the electronic level having no electron is very short, the three-dimensional system exhibits properties near the metal at a temperature above a certain degree. In this case, the simple cubic lattice makes behavior similar to that of the square lattice in the fourth Example. Thus, by changing the lattice constant, it is possible to change the band structure from the one-dimensional semiconductor to the semiconductor near the metallic state.

The impurity states are almost localized at a ball when the distance between balls is large. An electron-hole pair may be thermally excited in a ball. An electric field breaks the electron pair to release a conductive electron and hole. Those electrons and holes can tunnel from ball to ball, and the motions are strongly correlated by the Coulomb interaction. The system is interesting for the tunneling transport of strongly correlated electrons and holes.

EXAMPLE 6

Figure 11:
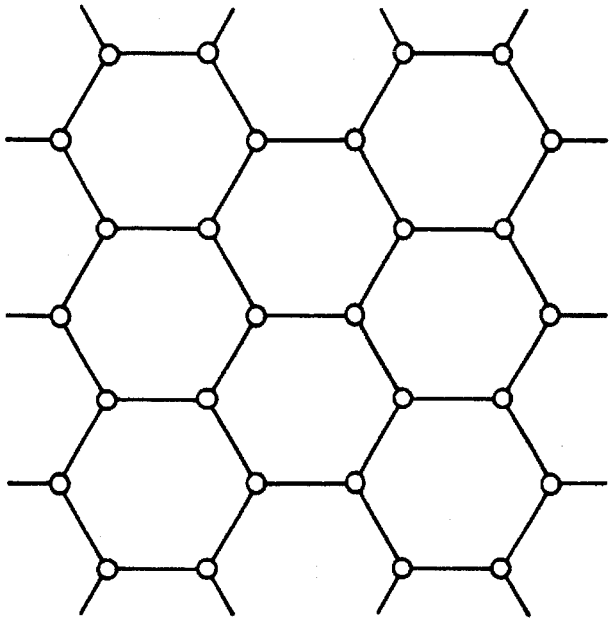
FIG. 11 is a schematical and partial view showing a structure of a hexagonal plane lattice according to a sixth example of this invention.

Referring now to FIG. 11, there is shown a schematical and partial view of a sixth example of a hexagonal plane lattice formed by three-point junctions according to this invention, in which three cylindrical carbon nanotubes with index A(4,0) are bonded to each of soccer ball-like spherical high-molecular weight carbon materials, $C_{60}$, in the same manner as mentioned above. In the drawing, a sphere and a line are as defined in Example 2.

EXAMPLE 7

Figure 12:
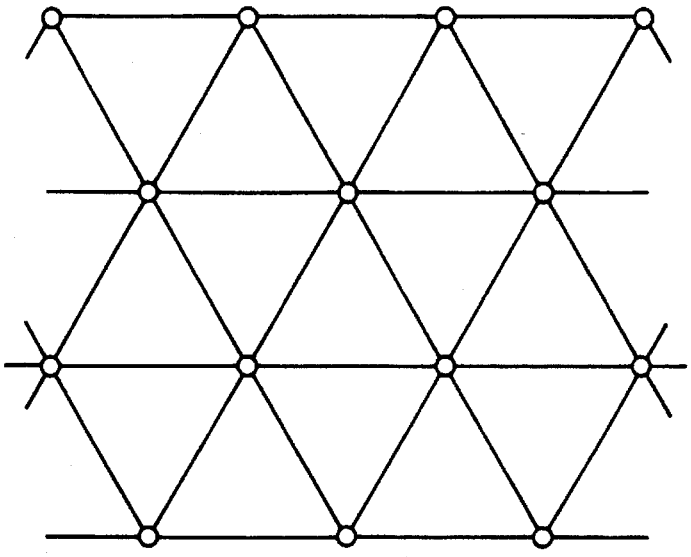
FIG. 12 is a schematical and partial view showing a structure of a triangle plane lattice according to a seventh example of this invention.

Referring now to FIG. 12, there is shown a schematical and partial view of a seventh example of a triangle plane lattice formed by six-point junctions according to this invention, in which six cylindrical carbon nanotubes with index A(4,0) are bonded to each of soccer ball-like spherical high-molecular weight carbon materials, $C_{60}$, in the same manner as mentioned above. In the drawing, a sphere and a line are as defined in Example 2.

EXAMPLE 8

Figure 13A:
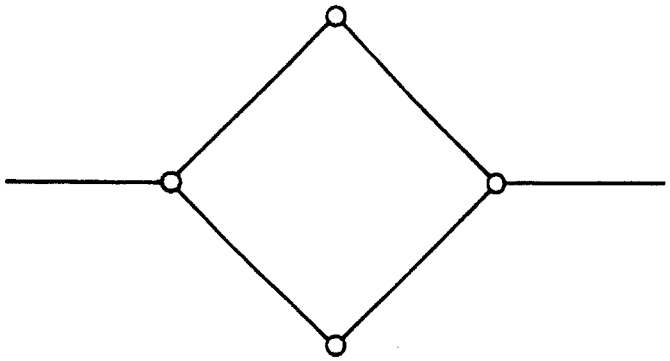
FIGS. 13A–13C are schematical views showing Aharonov-Bohm rings of square, hexagonal, and 2N-polygonal (N is an integer of 4 or more) ring-shaped high-molecular weight carbon materials each having two terminals thereon, according to an eighth example of this invention.
Figure 13B:
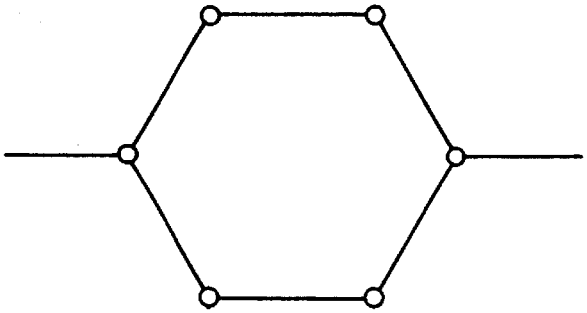
Figure 13C:
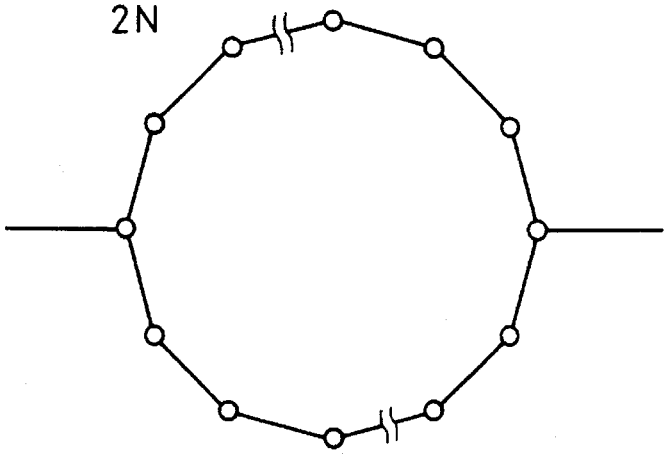

Referring now to FIGS. 13A, 13B and 13C, there are shown schematical views of an eighth example of ring-shaped high-molecular weight carbon materials each having two terminals thereon, respectively, in which the ring-shaped material in the form of square, hexagon or 2N-polygon (N is an integer of 4 or more) is made by connecting cylindrical high-molecular weight carbon materials (i.e. carbon nanotube) to soccer ball-like spherical high- molecular weight carbon materials (i.e. balls) to form square, hexagonal or 2N-polygonal ring-shaped materials, provided that two three-legged balls are used at the symmetrical positions on the ring-shaped material. These rings are called Aharonov-Bohm ring. In the drawings, a sphere and a line are as defined in Example 2.

In addition, the ring-shaped material may be a ring-shaped material having polyterminals thereon, and the ring may be of either of regular or irregular type.

EXAMPLE 9

Figure 14:
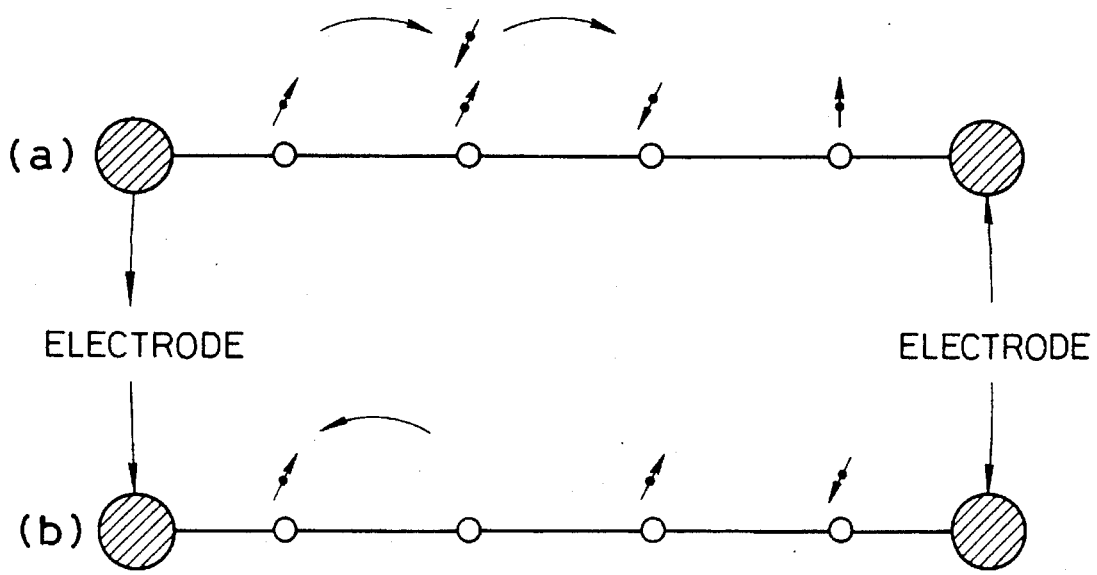
FIG. 14 shows a model for explaining a theory concerning a one-dimensional carrier unit conductive high-molecular weight carbon material according to a ninth example of this invention.

Referring now to FIG. 14, there is shown a schematic view for explaining a ninth example of this invention. The view shows a model explaining a theory concerning a one-dimensional carrier unit conductive high-molecular weight carbon material.

First, in order to explain the gist of this example, there is proposed a one-dimensional periodic lattice. Namely, the one-dimensional lattice is such that cylindrical carbon nanotubes are bonded to soccer ball-like spherical carbon materials. Considering lattice spacing, i.e. lattice constant, the band structure can be changed continuously from the semiconductor to the metal of A(4,0), and thus the localized states of the spherical material are formed as mentioned above. If the one-dimensional crystal is periodic, the localized states are at the same energy level and the electrons can be transported or tunnel from ball to ball, i.e. from impurity to impurity. However, in the case that Coulomb repulsion makes it difficult to increase or decrease electron numbers on each impurity by two or more, the transport of one electron is restricted by the other electron. For the simplification of explanation of the electron transport property, it is assumed that, when one ball is localized and two electrons exist, the energy increases by U(U>0) by the Coulomb repulsion force. If the energy of impurity level plus U is situated below the upper conduction band shown in FIG. 14, the electron is represented in terms of Hamiltonian "H" (Equation I) of Hubbard.

$$H = \sum_j t|j><j+1| + U\sum_j n_j\uparrow n_j\downarrow \quad \text{(I)}$$

In the above equation, "t" represents transfer integral between the closest lattices, "j" represents lattice point, and "U" represents Coulomb repulsion energy between electrons which are situated on the same lattice point and have spin in opposite directions.

In the above situation as represented by Hubbard Hamiltonian "H" (the above Equation I), if one electron or one hole is injected ((a) or (b) in FIG. 14), the carrier transports between the balls one by one but the situation of transport is extremely different from the case where the interaction "U" is zero. Namely, in this example, the energy parameters "t" and "U" can be of far more great values as compared with the thermal energy, $k_BT$=0.0259 eV, to room temperature and thus it is possible to attain a conductor of one electron unit which is operated at room temperature.

As mentioned above, there are shown some aspects of the band structure seen in non-limited examples. However, a variety of other examples can be easily conceived by a person having ordinary skill in the art. Although a semiconducting tube A(4,0) is used as a constituent unit, the other tubes including a metallic tube such as A(6,3) may be used as a constituent unit. In addition, tubes of various types may be mixed and aperiodic systems may be formed. Furthermore, more complex three-dimensional circuits can be imagined.

As discussed above, according to this invention, various high-molecular weight carbon materials with a one-dimensional, two-dimensional or three-dimensional structure are formed by bonding the cylindrical high-molecular weight carbon materials to the soccer ball-shaped spherical high-molecular weight carbon material as a point of junction or contact. The distance between the spherical materials can be controlled by adjusting the length of cylindrical material, whereby the one-dimensional band structure in the cylindrical material can be combined with properties of the localized electronic state of the spherical material and thus various band structures from the metal to the semiconductor can be realized according to this invention. Furthermore, effective mass of a carrier can also be changed. In addition, this invention has an effect of making localized impurity level at the band gap region of carbon nanotubes. Also, it is possible to generate permanent electric current by forming the ring and to bring about an Aharonov-Bohm effect by attaching electrodes to the ring.

While this invention has been described in connection with certain preferred embodiments, it is to be understood that the subject matter encompassed by way of this invention is not to be limited to those specific embodiments. On the contrary, it is intended for the subject matter of the invention to include all alternatives, modifications and equivalents as can be included within the spirit and scope of the following claims.

What is claimed is:

1. A high-molecular weight carbon material comprising two cylindrical high-molecular weight carbon materials in a form of a cylindrical tube having the same or different radius and a soccer ball-like spherical high-molecular weight carbon material having a radius larger than that of said cylindrical high-molecular weight carbon materials, each of said cylindrical high-molecular weight carbon materials having a rolled plane network including a benzene shell-like hexagonal molecule of covalent-bonded carbon atoms as a constituent unit, said soccer ball-like spherical high-molecular weight carbon material including molecules of five- and six-membered carbon rings as a constituent unit, and said soccer ball-like spherical high-molecular weight carbon material being bonded to each said cylindrical high-molecular weight carbon material.

2. The high-molecular weight carbon material as defined in claim 1, wherein said cylindrical high-molecular weight carbon materials and said soccer ball-like spherical high-molecular weight carbon material are linearly arranged.

3. The high-molecular weight carbon material as defined in claim 1, wherein said cylindrical high-molecular weight carbon materials and said soccer ball-like spherical high-molecular weight carbon material are arranged through said soccer ball-like high-molecular weight carbon material to form any desired angles.

4. A high-molecular weight carbon material comprising "m", wherein m is an integer of 2 or more, of cylindrical high-molecular weight carbon materials in a form of a cylindrical tube having the same or different radius and "n", wherein n is an integer of 1 or more, of soccer ball-like spherical high-molecular weight carbon materials each of which has a radius larger than that of said cylindrical high-molecular weight carbon materials, each of said cylindrical high-molecular weight carbon materials having a rolled plane network including a benzene shell-like hexagonal molecule of covalent-bonded carbon atoms as a constituent unit, each of said soccer ball-like spherical high-molecular weight carbon materials including molecules of five- and six-membered carbon rings as a constituent unit, and said soccer ball-like spherical high-molecular weight carbon materials being bonded to said cylindrical high-molecular weight carbon materials such that said cylindrical high-molecular weight carbon materials and said soccer ball-like spherical high-molecular weight carbon materials are alternately bonded.

5. The high-molecular weight carbon material as defined in claim 4, wherein said cylindrical high-molecular weight carbon materials and said soccer ball-like spherical high-molecular weight carbon materials are linearly arranged so as to form a linear chain.

6. The high-molecular weight carbon material as defined in claim 4, wherein said cylindrical high-molecular weight carbon materials and said soccer ball-like spherical high-molecular weight carbon materials are arranged so as to form any desired angles and form a linear chain.

7. The high-molecular weight carbon material as defined in claim 4, wherein said n is equal to m−1.

8. The high-molecular weight carbon material as defined in claim 4, wherein said n is equal to m.

9. The high-molecular weight carbon material as defined in claim 4, wherein said n is equal to m+1.

10. The high-molecular weight carbon material as defined in claim 4, wherein said m is 2 and said n is 1.

11. The high-molecular weight carbon material as defined in claim 4, wherein said "n" is equal to said "m", and said cylindrical high-molecular weight carbon materials and said soccer ball-like spherical high-molecular weight carbon materials are arranged so as to form a ring.

12. The high-molecular weight carbon material as defined in claim 11, wherein said ring is selected from the group consisting of regular triangle, tetragonal, pentagonal and hexagonal rings.

13. The high-molecular weight carbon material as defined in claim 4, wherein said soccer ball-like spherical high-molecular weight carbon material forms localized centers of electrons and the electrons are subjected to hopping conduction among the localized centers one by one under conditions that strong repulsion force between electrons makes it difficult to increase or decrease the number of localized electrons on each spherical carbon material by two or more.

14. The high-molecular weight carbon material as defined in claim 4, wherein said high-molecular weight carbon material has band structure which can be changed continuously from a semiconductor to a metal depending on a distance between soccer ball-like spherical high-molecular weight carbon materials as defined in claim 4.

15. A high-molecular weight carbon material comprising three or more of cylindrical high-molecular weight carbon materials in a form of a cylindrical tube having the same or different radius and a soccer ball-like spherical high-molecular weight carbon material, each of said cylindrical high-molecular weight carbon materials having a rolled plane network including a benzene shell-like hexagonal molecule of covalent-bonded carbon atoms as a constituent unit, said soccer ball-like spherical high-molecular weight carbon material including molecules of five- and six-membered carbon rings as a constituent unit, and said soccer ball-like spherical high-molecular weight carbon material being bonded to each said cylindrical high-molecular weight carbon material.

16. The high-molecular weight carbon material as defined in claim 15, wherein a structure of said high-molecular weight carbon material is selected from the group consisting of a symmetrical one-dimensional three-legged structure with one leg in a direction of each apex of a regular triangle from a center of gravity thereof, a three-legged structure in a form of T-type, a four-legged structure in a form of a cross in the same plane, a cubic four-legged structure with one leg in a vector direction of each apex of a regular tetrahedron from a center of gravity thereof, a plane structure with six legs in a form of starfish, and a cubic structure with six legs in directions of x, y and z.

17. The high-molecular weight carbon material as defined in claim 15, wherein said spherical high-molecular weight carbon material forms localized centers of electrons and the electrons are subjected to hopping conduction among the localized centers one by one under conditions that strong repulsion force between electrons makes it difficult to increase or decrease the number of localized electrons on each spherical carbon material by two or more.

18. The high-molecular weight carbon material as defined in claim 15, wherein said high-molecular weight carbon material has band structure which can be changed continuously from a semiconductor to a metal depending on a distance between soccer ball-like spherical high-molecular weight carbon materials as defined in claim 15.

19. A high-molecular weight carbon material comprising a cylindrical high-molecular weight carbon material or the high-molecular weight carbon material as defined in claim 4 and the high-molecular weight carbon material, as a junction point, defined in claim 15, said cylindrical high-molecular weight carbon material having a rolled plane network including a benzene shell-like hexagonal molecule of covalent-bonded carbon atoms as a constituent unit and said cylindrical high-molecular weight carbon material or said high-molecular weight carbon material of claim 4 being bonded to said high-molecular weight carbon material of claim 15.

20. The high-molecular weight carbon material as defined in claim 19, wherein said high-molecular weight carbon material of claim 19 is a hexagonal plane lattice formed by three-point junction.

21. The high-molecular weight carbon material as defined in claim 19, wherein said high-molecular weight carbon material of claim 19 is a triangle plane lattice formed by six-point junction.

22. The high-molecular weight carbon material as defined in claim 19, wherein said junction point in said high-molecular weight carbon material of claim 19 have a periodic structure or a topological structural order which is two-dimensionally or three-dimensionally arranged.

23. The high-molecular weight carbon material as defined in claim 19, wherein said spherical high-molecular weight carbon material forms localized centers of electrons and the electrons are subjected to hopping conduction among the localized centers one by one under conditions that strong repulsion force between electrons makes it difficult to increase or decrease the number of localized electrons on each spherical high-molecular weight carbon material by two or more.

* * * * *